United States Patent [19]

Minke et al.

[11] 4,186,970

[45] Feb. 5, 1980

[54] SECTIONAL CONVEYOR WITH SECTIONAL RACK FIXED ON THE CONVEYOR AT ONLY A SINGLE LOCATION

[75] Inventors: Otto Minke, Essen; Willy Lanfermann, Bochum, both of Fed. Rep. of Germany

[73] Assignee: Ruhrkohle, A.G., Essen, Fed. Rep. of Germany

[21] Appl. No.: 817,564

[22] Filed: Jul. 21, 1977

[30] Foreign Application Priority Data

Jul. 24, 1976 [DE] Fed. Rep. of Germany ..... 2633336

[51] Int. Cl.[2] ..... E21C 27/36

[52] U.S. Cl. ..... 299/43; 105/29 R

[58] Field of Search ..... 299/32, 34, 42–46; 198/735, 864; 105/29 R; 104/147 R, 165

[56] References Cited

U.S. PATENT DOCUMENTS

| | | | |
|---|---|---|---|
| 3,999,551 | 12/1976 | Steinkuhl | 198/735 X |
| 4,054,321 | 10/1977 | Jarvis | 299/34 X |
| 4,055,367 | 10/1977 | Jarvis | 299/43 X |
| 4,082,361 | 4/1978 | Lanfermann | 299/43 |

FOREIGN PATENT DOCUMENTS

| | | | |
|---|---|---|---|
| 525021 | 12/1953 | Belgium | 198/735 |
| 1051740 | 1/1954 | France | 198/735 |

*Primary Examiner*—Ernest R. Purser
*Assistant Examiner*—Nick A. Nichols, Jr.
*Attorney, Agent, or Firm*—Andrus, Sceales, Starke & Sawall

[57] ABSTRACT

A thrust device for a coal cutter running on a sectional string of trunking of a chain conveyor comprises a pinion on the coal cutter cooperating with a rack located on the conveyor. The rack is formed of a plurality of linked sections only one of which is firmly attached to the conveyor, the other sections being guided for longitudinal movement relative to the conveyor. The purpose of this arrangement is to avoid straining the rack or producing tooth pitch variations at the junctions of adjacent rack sections when the trunking flexes due to geological disturbances.

9 Claims, 6 Drawing Figures

SECTIONAL CONVEYOR WITH SECTIONAL RACK FIXED ON THE CONVEYOR AT ONLY A SINGLE LOCATION

BACKGROUND OF THE INVENTION

1. Field of the Invention

This invention relates to a thrust device for a mining machine cooperating with a sectional conveyor, in particular at the face below ground, e.g. for a roller coal cutter running on a string of trunking of a chain conveyor, wherein traverse of the coal cutter takes place by means of a pinion engaging with a rack located on the conveyor and preferably divided into equal longitudinal sections.

2. Description of the Prior Art

In such devices, power is usually supplied to the pinion by a drive located on the coal cutter. Rotation of the pinion is converted by means of the rack into a linear thrust which propels the coal cutter along the face. The sections of the conveyor, which preferably consist of a chain conveyor with a string of trunking and a chain drive located at one or both ends, often serve as a rail track for the cutter, absorbing the reaction forces of the thrust device.

On the one hand, the string of trunking must be able to yield in a horizontal and vertical direction at the joints between the trunking, so that the string is, in the event of geological disturbances, in a position to deflect in two planes at right angles to each other. For this reason, the majority of conveyors have a degree of play between their sections which, in the case of the trunking of chain conveyors, can, for example, amount to 15 mm. On the other hand, the thrust force transferred to the trunking leads to a displacement of the line of trunking, mainly in its longitudinal direction, the total displacement observed along the face, as a rule, amounting to several times the degree of play.

In a known design ("Gluckauf" 111, 1975, No. 18 863, FIG. 4), the rack is divided into longitudinal sections which are firmly connected together, but are fixed to the trunking in a manner permitting limited play in the longitudinal direction, by way of bolts and elongated holes. As the elongated holes, which determine the degree of play, can only be given a limited length, while the conveyor is made up of a plurality of sections of trunking whose individual play is multiplied at the end of the conveyor, a difficulty arises in that the conveyor is maintained practically rigid by the rack so that destructive thrust forces are applied to the longitudinal sections of the rack. If, however, the necessary length compensation of the individual conveyors were supplemented by a corresponding compensation for the sectional lengths of the rack, then there would occur pitch errors at the junction of the adjacent longitudinal sections which could adversely affect propulsion of the cutter. Because of this, the known design could not be utilised where trunking lines were installed with the normal play and/or geological disturbances with hollows and ridges were to be overcome.

It is also known (German Gebrauchsmuster No. 1,781,817) to employ a sprocket chain instead of a rack divided into longitudinal sections, which chain is fixed at both ends in a manner permitting limited yielding and is guided on the conveyor between the fixing points. However, the problem of length compensation can not be solved by this means either. On the other hand, in practice, thrust devices have proved themselves of use in which in place of the pinion a sprocket chain is used and, for the rack, drive shafts having movable cylindrical bolts ("Gluckauf", supra, 862). With these shafts also, meshing inaccuracies occur under the operational necessity of length compensation, which are apparently taken up by the play present in the chain. Chains of this kind are, however, relatively complicated and sensitive elements of machinery.

SUMMARY OF THE PRESENT INVENTION

The main object of the invention is, in a device of the kind described above, to make possible length compensation of the longitudinal rack sections and to ensure the normal displaceability of the string of trunking, without meshing inaccuracies occurring.

This object may be accomplished when the longitudinal sections are linked together and are displaceable in the longitudinal direction of the conveyor, and the rack consisting of the longitudinal sections is firmly attached to the conveyor at one point and guided along the conveyor.

The invention accordingly provides a thrust device for a mining machine cooperating with a sectional conveyor, in which traverse of the mining machine takes place by means of a pinion engaging with a rack which is located on the conveyor and is divided into longitudinal sections, wherein the longitudinal sections are linked together and are displaceable in the longitudinal direction of the conveyor, and the rack consisting of the longitudinal sections is firmly attached to the conveyor at one point and guided along the conveyor.

Because the longitudinal sections are guided, being linked and connected together and displaceable in the longitudinal direction of the conveyor, no thrust forces are directly transferred from the longitudinal sections to the conveyor except at the single point of attachment of the rack. Rather, the reaction forces occurring are transferred to the single attachment point and there fed into the string of trunking. Because of this, the operationally necessary length compensation of the string of trunking can be carried out without affecting the rack and meshing inaccuracies can be avoided even at the junctions of adjacent longitudinal rack sections.

The invention has the advantage that for propulsion of the cutter a pinion and a simple rack can be employed, which are relatively simply constructed elements of machinery and therefore particularly suitable for mining. The invention achieves an absolutely even and jolt-free forward movement of the cutter because of the overall equal spacing of the teething, whilst, on the other hand, the string of trunking retains its normal horizontal and vertical movability.

Preferably, when the conveyor is mounted horizontally, the attachment point of the rack is located in the middle of the conveyor and the longitudinal sections are approximately half as long as the conveyor sections. This embodiment of the invention is intended for applications in which the cutter has to cut so-called "stalls" and/or extract them. Then it is necessary to run the cutter over the bridging trunking and the drives up to the end of the conveyor. When the play between the conveyor trunking is not taken up, the end of the last longitudinal section then stands proud to about the extent of half the width of a trunking section, at each end of the conveyor. When the longitudinal compensation is effected, then a corresponding reserve length of rack becomes available which enables driving of the cutter to the respective end of the conveyor.

On descending faces, on the other hand, it is practicable to locate the attachment point of the rack at the lower end, as a rule, in the vicinity of the main drive.

According to a further feature of the invention, guides are located below the rack linkages which are located below the rack between its longitudinal lengths. This feature of the invention permits the use of the sides of the rack as an additional guide and ensures accurate tracking of the pinion. Although the linkages lie below the teething, resulting in slight variations in tooth pitch when the rack sections are not horizontally aligned, in practice these do not assume any dangerous magnitude, i.e. the jolt-free and even forward movement of the cutter is retained even when the linkages are actuated.

BRIEF DESCRIPTION OF THE DRAWING

An embodiment of the invention will now be described, by way of example, with reference to the accompanying drawings, in which.

DETAILED DESCRIPTION OF THE PREFERRED EMBODIMENT

Figure 1:
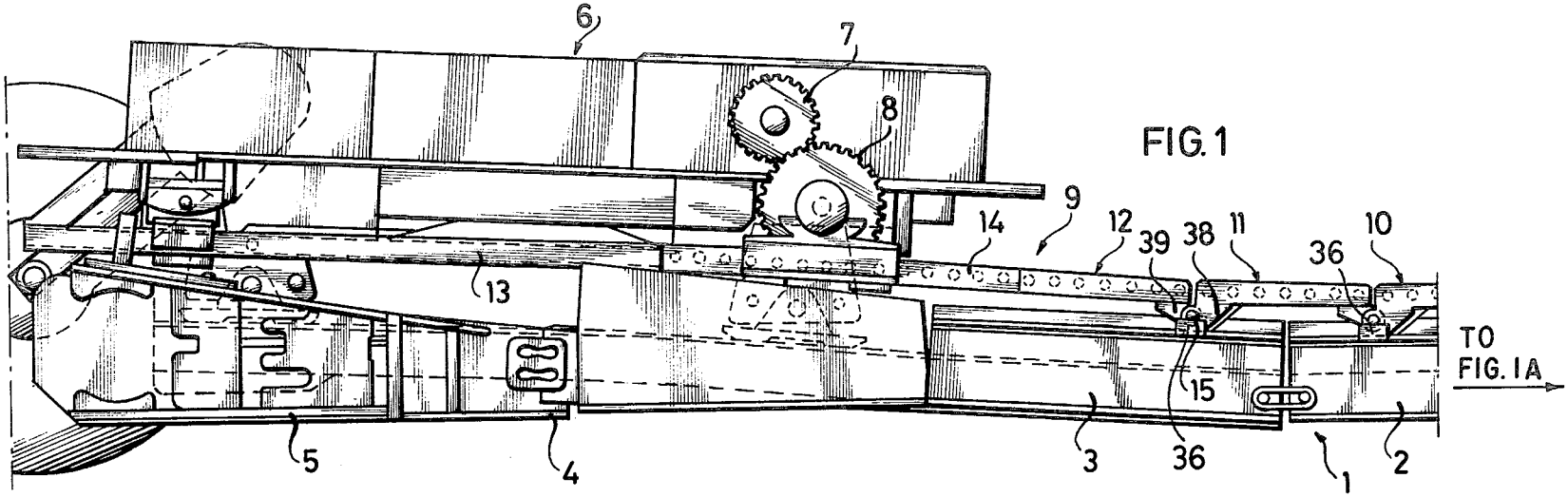
FIG. 1 is a side view of an end of a conveyor with a cutter which can run on it.
Figure 2:
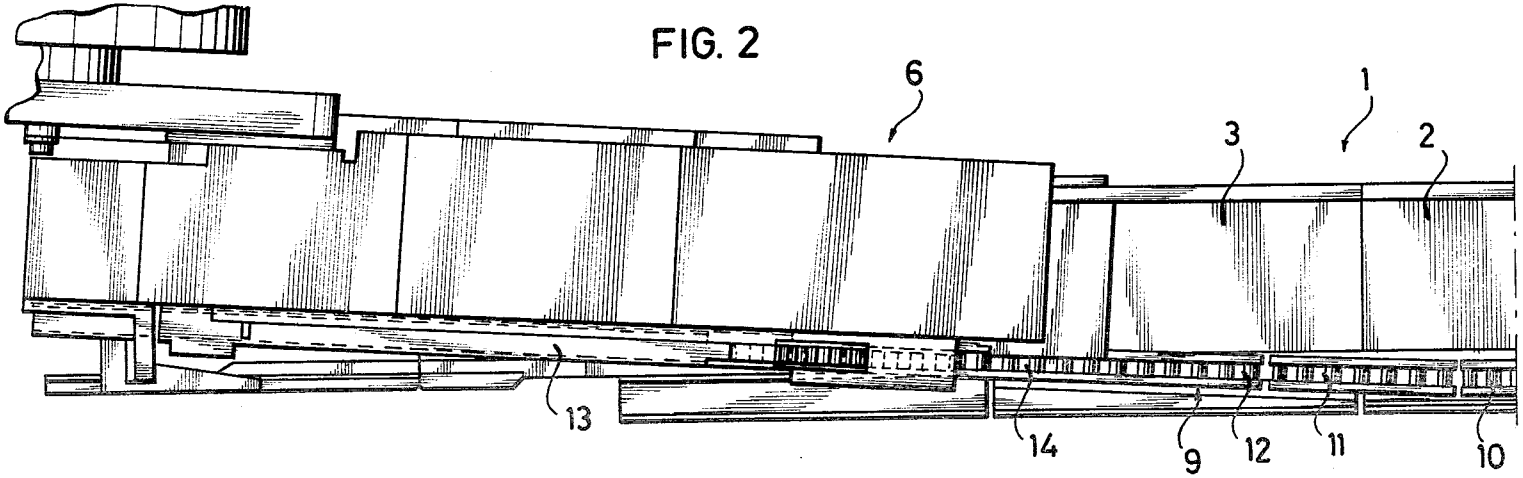
FIG. 2 is a plan view of the conveyor and cutter of FIG. 1.
Figure 1A:
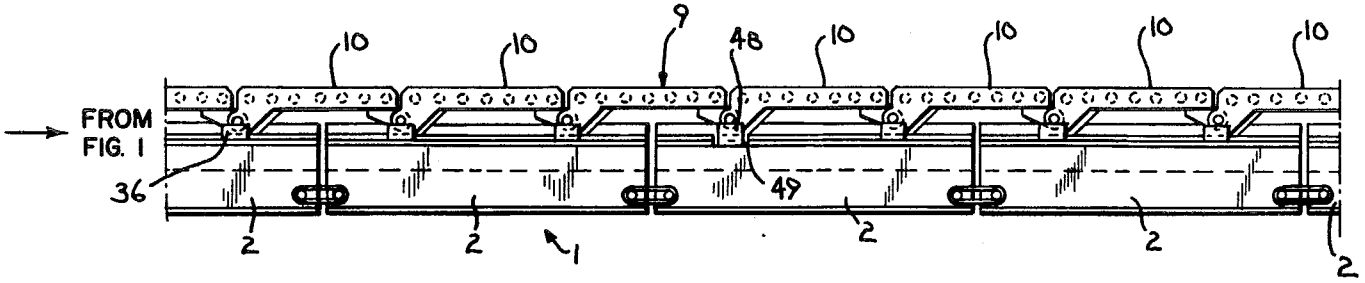
FIG. 1A is a side view, similar to FIG. 1, showing an extension of the conveyor to include the point of fixing of the rack to the conveyor.

Shown in FIG. 1 is a chain conveyor having a stationary part formed by a string of trunking 1 which consists of single pieces of standard trunking 2 and/or 3, a bridging piece of trunking 4 and a thrust piece of trunking 5. The thrust piece of trunking 5 is located at one end of the conveyor; a further thrust piece can be located at the opposite end of the conveyor (not shown). A roller coal cutter 6 uses the string of trunking 1 as a rail track and travels in the longitudinal direction of the string of trunking 1. A pinion 8 driven through a gear 7 and cooperating with a rack 9 is provided for propulsion of the cutter 6. The rack 9 is divided into individual longitudinal sections 10 to 12. Further longitudinal sections 13 and 14 are also provided for driving the conveyor. The trunking sections of the conveyor have, for example, a length of 1500 mm. The rack sections are connected together with the aid of horizontal linkages 15 and measure 750 mm between the centre lines of two adjacent linkages.

One side of the cutter 6 is supported at 16 on the trunking wall 17 adjacent the coal face 18. On the other side, the cutter 6 is supported on the rack 9 and guided by two laterally spaced and longitudinally extending members 19 and 19', an upper support bar 20 and a lower guide member 21. The rack 9 is of ladder-like construction, i.e. having a pair of longitudinally extending steel members 23 and 24 of rectangular cross-section, with cylindrical bolts 25 extending between the members 23 and 24. The pinion 8 is preferably so constructed that two of its teeth are always engaged with the teething of the rack 9.

Figure 3:
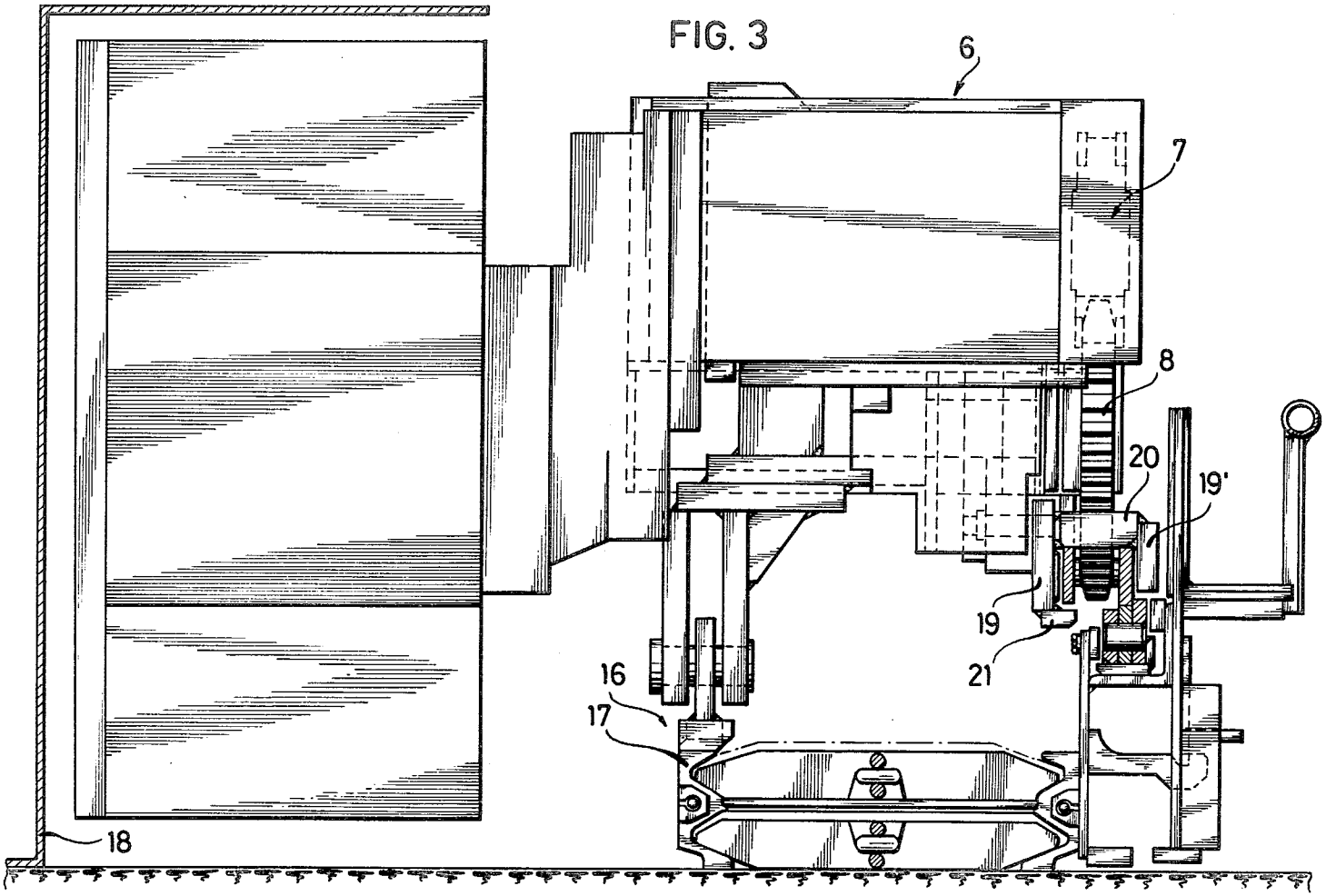
FIG. 3 is an enlarged section through one of the linkages connecting two longitudinal sections of the rack.
Figure 3A:
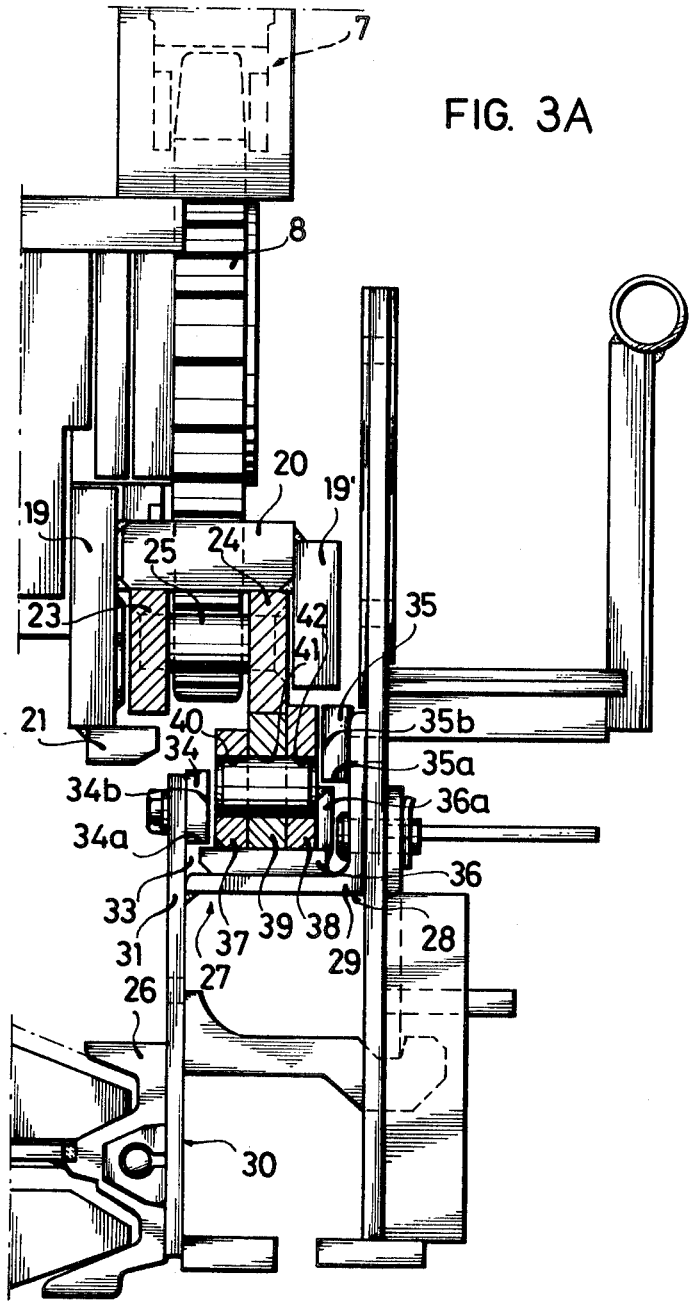
FIG. 3A is a detail of FIG. 3 on an enlarged scale.

The construction of the linkages used for interconnecting the longitudinal sections 10 to 12 of the rack 9 can be particularly seen in FIG. 3A. A channel 27 is formed on the rear side of the leg 26 of the trunking on the side away from the coal face. It consists of an angle section 28 which has one leg 29 welded to a metal sheet 30 which forms a wall of a cable channel provided on the rear side of the conveyor. The upper end 31 of the sheet 30 projects upwardly above the inner side of the angle arm 29 so that a generally U-shaped channel 33 is formed, open at the top.

Portions of channels 27 and 33 have been omitted from FIG. 1 to more clearly show the relationship between rack 9 and trunking 1. On each longitudinal wall of the channel there is a guide strip 34, 35, the strip 34 being screwed to the section 28 and the strip 35 being screwed to the metal sheet 30. Within the channel 33, is supported a shoe 36 which is fastened to a bracket made up of two parts 37 and 38 respectively. A second bracket 39 fits between the parts 37 and 38. The two-part bracket 37 and 38 and the second bracket 39 are provided on the member 24 on the side of the rack away from the coal face 18. As can be seen in FIG. 1, each longitudinal section 10, 11 or 12 has a bracket 39 at one end and a two-part bracket 37 and 38 at the other end. As can be seen in FIG. 3, in the linkages 15, the brackets fit into each other so that bores 40, 41 and/or 42 provided therein are in line with each other and can accept a bolt. The brackets fitted to the ends of adjacent longitudinal sections 10 to 12 thus form the side members of the linkages whose link pins are formed by the bolts in the aligned bores of the brackets.

Figure 4:
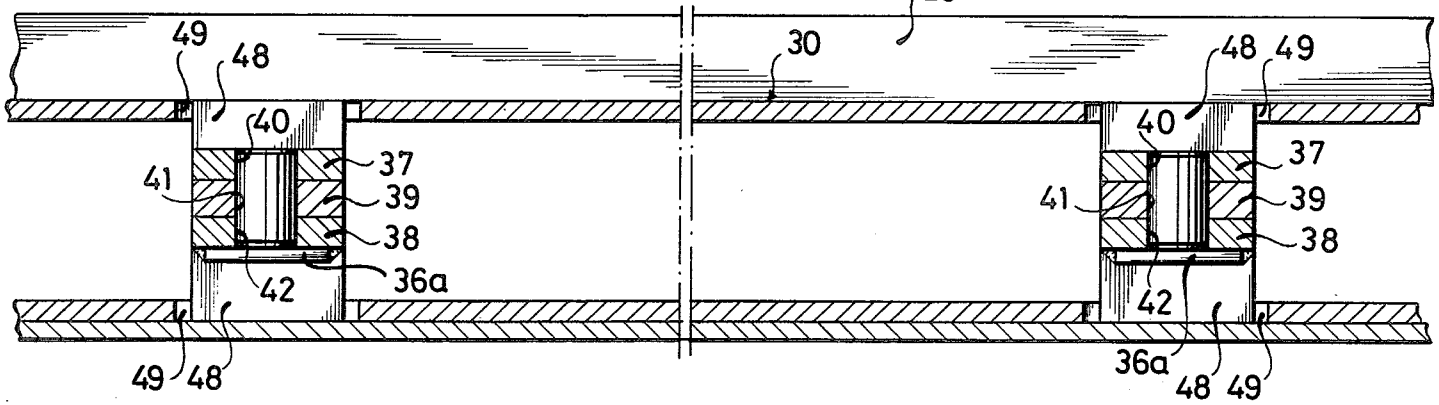
FIG. 4 is a top view, partially in section, showing fixing of the rack to the conveyor at the single point.

The rack 9 is only fixed at one point, approximately in the middle of the string of trunking. At this point, as shown in FIG. 4, the brackets are provided with extensions 48 which engage with recesses 49 in the side walls of the channel 33. Thus the relevant longitudinal rack section is positioned with respect to the conveyor.

The remaining rack sections are guided for longitudinal displacement whilst being prevented from displacement out of the channel 33. For this purpose, the shoe 36 includes a vertical portion 36*a* at the side away from the coal face 18, which engages beneath the lower edge 35*a* of the strip 35, whilst the other side of the shoe 36 engages beneath the lower edge 34*a* of the strip 34. Lateral guiding is effected by the inner sides 34*b* and 35*b*, respectively, of the strips 34 and 35.

Instead of a U-shaped channel, a tube can be employed on which the longitudinal sections are displaceably guided.

What is claimed is:

1. In a mining machine having a movable cutting head with a driving pinion, a thrust device for said machine comprising:

a sectional conveyor lying in the direction of the path of travel of the cutting head, the sections of said conveyor being linked together for limited relative displacement along the direction of the path of travel; and a sectional rack extending along said conveyor for receiving said pinion to traverse the cutting head on the conveyor, the sections of said rack being linked together for relative pivotal movement, one section of said rack being fixed to said conveyor at a single location along said rack and conveyor, all other sections of said rack being only slidably retained on said conveyor for movement with respect to said conveyor in the direction of said path of travel.

2. The thrust device according to claim 1 wherein the fixing location of said rack to said conveyor is located substantially centrally of the extension of the conveyor in the path of travel.

3. The thrust device according to claim 1 wherein the dimension of the sections of the rack in the direction of the path of travel are approximately half as long as the dimension of the sections of the conveyor in the direction of the path of travel.

4. The thrust device according to claim 1 wherein each of said rack sections includes two parallel side members and pins extending between said side members to produce a structure of ladder like form.

5. The thrust device according to claim 1 wherein sections of said rack include guide means for facilitating the movement of the sections of said rack with respect to the conveyor.

6. The thrust device according to claim 5 wherein sections of said rack have hinge members at either end thereof for linking said sections together for relative pivotal movement and wherein said hinge means include said guide means.

7. The thrust device according to claim 6 wherein said hinge means include apertured brackets at each end of said rack section and link pins lying in the apertures of said brackets to connect adjacent rack sections.

8. The thrust device according to claim 5 wherein said conveyor has an upwardly open channel for receiving said guide means of said rack.

9. The thrust device according to claim 8 wherein said channel includes means for retaining said rack guide means in said channel.

* * * * *